US007866312B2

(12) United States Patent
Erdmann

(10) Patent No.: US 7,866,312 B2
(45) Date of Patent: Jan. 11, 2011

(54) VENTILATION HOOD AND COOKTOP SAFETY SYSTEM AND METHOD

(75) Inventor: Klaus Erdmann, Knittlingen (DE)

(73) Assignee: BSH Home Appliances Corporation, Huntington Beach, CA (US)

( * ) Notice: Subject to any disclaimer, the term of this patent is extended or adjusted under 35 U.S.C. 154(b) by 200 days.

(21) Appl. No.: 11/641,372

(22) Filed: Dec. 18, 2006

(65) Prior Publication Data

US 2008/0141996 A1 Jun. 19, 2008

(51) Int. Cl.
*F24C 15/20* (2006.01)

(52) U.S. Cl. ..... 126/299 D; 126/299 R; 126/299 F; 454/61

(58) Field of Classification Search ..... 126/299 D, 126/299 R, 299 F; 454/61
See application file for complete search history.

(56) References Cited

U.S. PATENT DOCUMENTS 3,409,005 A * 11/1968 Field ..... 126/300
3,690,245 A * 9/1972 Ferlise et al. ..... 126/299 D
5,139,009 A 8/1992 Walsh
5,215,497 A 6/1993 Drees
5,642,784 A 7/1997 Guay et al.
5,771,879 A 6/1998 Saltzman
6,142,142 A * 11/2000 Woodall et al. ..... 126/299 R
6,170,480 B1 1/2001 Melink et al.
6,446,624 B1 * 9/2002 Chu ..... 126/299 R
6,578,569 B2 * 6/2003 Liese ..... 126/299 R
6,913,012 B2 * 7/2005 Divett et al. ..... 126/21 A
6,920,874 B1 * 7/2005 Siegel ..... 126/299 R

FOREIGN PATENT DOCUMENTS

JP 1-210747 8/1989
JP 2-93231 4/1990
JP 5-1835 1/1993

* cited by examiner

*Primary Examiner*—Kenneth B Rinehart
*Assistant Examiner*—Chuka C Ndubizu
(74) *Attorney, Agent, or Firm*—James E. Howard; Andre Pallapies

(57) ABSTRACT

A ventilating hood and cooktop system includes safety components to reduce or eliminate the possibility of a fire in the ventilating hood. The system provides elements for sensing the temperature over the cooktop. When the temperature reaches a first predetermined level, the ventilation fan speed is increased. The system includes alarm warning elements which issue different signals depending on the temperature above the cooktop. If a maximum temperature is reached, the system shuts off the fan of the ventilating hood and shuts down the cooktop.

20 Claims, 2 Drawing Sheets

| | | |
|---|---|---|
| COOKTOP TURNED ON | HOOD ON FAN NORMAL SPEED | |
| COOKTOP ON TEMPERATURE LEVEL 1 | SIGNAL LAMP FAN SPEED INCREASE | WARNING OF HIGH HOOD TEMPERATURE |
| COOKTOP ON TEMPERATURE LEVEL 2 | AUDIBLE SIGNAL | WARNING OF DANGER OF CATCHING FIRE |
| COOKTOP ON TEMPERATURE LEVEL 3 | HOOD OF COOKTOP OF INDICATION OF ACTION | SHUT DOWN TO PREVENT FIRE |
| COOKTOP ON STEAM | HOOD ON FAN AT SPEED GOVERNED BY HUMIDITY | FAN SPEED INCREASED IN PROPORTION TO INCREASED HUMIDITY |

FIG. 2

VENTILATION HOOD AND COOKTOP SAFETY SYSTEM AND METHOD

BACKGROUND OF THE INVENTION

This invention relates to a ventilation hood with a safety system for use with a cooktop. More particularly, the invention relates to a ventilation hood with a safety system designed to substantially reduce the possibility of a fire occurring in the ventilation hood and ductwork thereof, as well as reducing humidity resulting from steam generated by the operation of the cooktop. The invention further relates to a combination of a ventilation hood and cooktop system, as well as a method of operation of a ventilation hood and a cooktop.

A number of ventilation hood control units are known for reducing the spread of smoke resulting from cooking operations on cooktops, as well as for removing humidity caused by steam resulting from cooking on the cooktop.

One known system provides a control or regulating device for a stove which activates, deactivates, controls and regulates the heat energy of cooking zones of the stove in dependence upon the resulting cooking steam. The control device and corresponding sensor of such a system is installed in the ventilation hood associated with the stove. Such a system is primarily focused on controlling the level of steam detected, to control operation of the cooking zones and not the ventilation fan. The makers of the system list as one of its advantages achieving a substantial savings of energy.

Another prior art system proposes a smart circuit device for a smoke exhauster for cooking. The circuit device includes a sensing circuit for sensing temperature and smoke. The motor of the fan and the exhauster is controlled to operate at a rotation speed conducive to reducing noise and save energy. The fan speed is varied in response to the quantity of smoke and is controlled by a fuzzy logic controller.

Yet still another system for a commercial or institutional kitchen provides that the volume rate of a cooking exhaust may be increased to improve the general comfort, health and safety conditions in the kitchen and the rest of the facility. More particularly, such a system senses a parameter in the ambient air environment such as temperature and/or gas level. Depending on the activity of the cooking units, the air control system causes the exhaust system to increase the volume rate to a higher volume rate to exhaust more air from the ambient air environment, thereby reducing the temperature in the facility to improve comfort and reduce load on an high volume air conditioning (HVAC) system.

While all of these systems provide advantages in reducing ambient smoke and/or steam for the purpose of providing a comfortable environment for persons using a cooktop, these conventional systems still fall short in providing an optimized arrangement designed to minimize fires occurring in ventilation hoods and cooktops.

More particularly, the use of cooktops in an incorrect manner contrary to a manufacturer's instructions can cause a fire. Many current gas cooktops have burners which can operate at energy levels of greater than 15,000 BTUs. Such cooktops include four to six burners and the simultaneous operation of multiple ones of these burners for a long period of time can overheat ventilation elements exhaust ducts.

The overheating of ventilation elements exhaust ducts is particularly of concern in circumstances in which such ventilation hoods and elements in ducts have accumulated oils and fat in the duct tubes thereof as such oils and fats are entrained with gases and/or vapors being drawn through the ventilation hood duct during cooking operations. If the heat conditions above the cooktop exceeds certain parameters such as may occur, for example, as a result of a flame, or through use of many of the high BTU burners at one time, a substantial portion of the heat generated may be drawn into the duct system and cause a fire as a result of, among other reasons, the ignition of the oils or fat accumulated in the duct tubes.

In accordance with the invention, there is provided a ventilation hood with a safety system, a combination of a ventilation hood with a cooktop and a method of controlling operation of a ventilation hood and cooktop, which avoids the problems of the previously discussed conventional systems, and which substantially reduces or eliminates the danger of fire occurring in the duct work of the ventilation hood as a result of operation of the cooktop.

BRIEF SUMMARY OF THE INVENTION

In accordance with one aspect of the invention, there is provided a ventilation hood with a safety system for use with a cooktop. The hood includes a duct structure for having air flow through the duct structure. A variable speed fan is associated with the duct structure for forcing air to flow from above the cooktop through the duct structure. A temperature sensor serves to sense the temperature above the cooktop and an alarming unit serves to provide at least one type of alarming indication. A controller unit is associated with the aforementioned elements for controlling operation of the fan and the alarming unit. The controller unit is configured for increasing the speed of the fan when in operation, and for activating the alarming unit to provide a first alarm indication upon the temperature above the cooktop reaching a first predetermined level, and for causing the alarming unit to provide a second alarm indication upon the temperature above the cooktop reaching a second (higher) predetermined temperature.

In accordance with one aspect of the present invention, the controller unit is also connected to a cooktop for controlling operation thereof. The controller unit is further programmed for causing the alarming unit to provide a third alarm indication upon the temperature above the cooktop reaching a third predetermined temperature and for shutting down the fan and the cooktop.

A method of operating a ventilation hood used with a cooktop includes providing a ventilation hood having a duct structure for having airflow therethrough. A temperature sensor is provided and serves to sense temperature above the cooktop. An alarming unit is also provided and serves to provide at least one type of alarm indication. A controller unit is provided which serves to control operation of the fan and alarming unit. The method involves sensing the temperature above the cooktop, increasing the speed of the fan and providing a first alarm indication upon the sensed temperature reaching a first predetermined level. A second alarm indication is provided upon the sensed temperature reaching a second predetermined (higher) level.

In accordance with a further aspect of the present invention, the controller unit is connected to a cooktop associated with the hood. The method further involves shutting off the cooktop and fan and providing a third alarm indication upon the sensed temperature reaching a third predetermined (even higher) level.

In accordance with yet another aspect of the present invention, the invention involves a combination of a ventilation hood and a cooktop including the features of the previously described ventilation hood as connected to the cooktop for controlling operation of the cooktop and the ventilation hood.

BRIEF DESCRIPTION OF THE DRAWING

FIG. 2 is a temperature status table illustrating the various operating states of the system of the present invention.

DETAILED DESCRIPTION OF THE INVENTION

Figure 1:
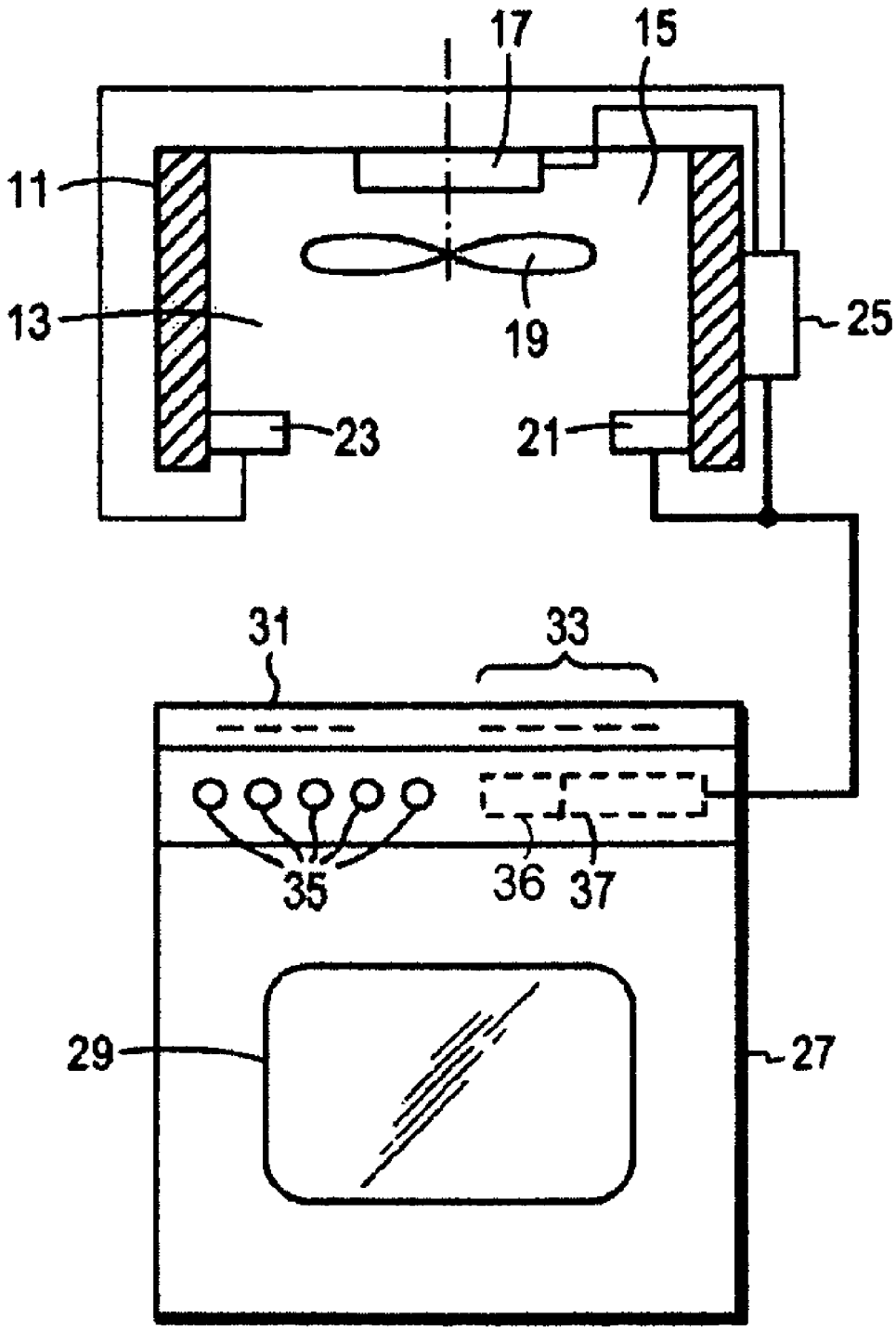
FIG. 1 is a front elevational view in partial section of a ventilation hood safety system connected to a freestanding range that comprises a cooktop, and showing the various elements of the present invention.

In accordance with the present invention, there is provided a ventilation hood 11 that includes a duct structure 13 and a variable speed fan 15 with a variable speed motor 17 and a plurality of associated fan blades 19. The hood 11 also includes a temperature or heat sensor 21 and a steam or humidity sensor 23, both connected to a controller unit 25. Associated with the ventilation hood 11 is a free standing range 27 including an oven 29, cooktop 31 including a plurality of burners 33, and controls 35 for controlling operation of the oven 29 and the burners 33. Also associated with the freestanding range 27 is an alarming unit including an alarm indicator 36 and an automatic control module 37, which, along with the temperature sensor 21 and the humidity sensor 23, is connected to the controller unit 25.

The operation of the ventilation hood 11 and the cooktop 31 will hereinafter be described with reference to the temperature status table set forth in FIG. 2 in accordance with which the system, including the controller unit 25 and the module 37, is programmed. Although the system of the present invention is described as being implemented via software programming, the same function can be provided by the appropriate hardware, as will be readily apparent to those of ordinary skill in the art. Such programming may be done in numerous ways through firmware, downloadable software, and other means as also will be readily apparent to those of skill in the art.

When at least one of the burners 33 of the cooktop 31 is turned on through the use of the controls 35, the automatic control module 37 provides feedback to the controller unit 25, whereupon the controller unit 25 activates the fan motor 17 to cause blades 19 of the fan 15 to rotate at a first normal operating speed. If the temperature above the cooktop 31 reaches a first predetermined level, as detected by the temperature sensor 21, the controller unit 25 causes the fan 15 to increase its speed and issues an alarm signal through the module 37. For example, if the first predetermined level of the temperature is deemed, purely for exemplary purposes, to be a temperature of between 100 degrees Fahrenheit (=one temperature unit) to 150 degrees Fahrenheit (=one and one-half temperature units), then the controller unit 25 may be controlled to cause the fan 15 to increase its speed when a temperature at the first predetermined level of the temperature is detected.

In a typical embodiment, the alarm signal can be activation of a signal lamp in the alarm indicator 36 of the module 37, which serves as a warning of high temperature in or in proximity to the ventilation hood 11.

If the temperature above the cooktop 31 continues to rise to a second temperature level, as detected by the temperature sensor 21, then the controller unit 25 causes the module 37 to issue a second alarm signal, for example, through a sound generator in the alarm indicator 36 as an audible signal. For example, if the second predetermined level of the temperature is deemed, purely for exemplary purposes, to be a temperature of between 150 degrees Fahrenheit (=one and one-half temperature units) to 200 degrees Fahrenheit (=two temperature units), then the controller unit 25 may be controlled to cause the module 37 to issue a second alarm signal when a temperature at the second predetermined level of the temperature is detected.

In an alternative aspect, the module 37 could have a visual display in the alarm indicator 36 or separately therefrom, capable of displaying text messages, and instead of an audible signal, a text message can be provided, both of which serve as a warning of an increased danger of catching fire which then allows the operator of the cooktop 31 to make decisions about continuing cooking operations.

If the temperature continues to rise to a third predetermined temperature level, as detected by the temperature sensor 21, then the controller unit 25 issues a signal to the fan motor 17 and to the module 37 which immediately shuts down the fan motor to avoid additional heat being drawn into the duct structure 13, and also causes the module 37 to shut down the burners 33 on the cooktop 31. A text message is then issued on the display of the module 11 indicating that the fan 15 and the burners 33 were shut down to avoid a fire. For example, if the third predetermined level of the temperature is deemed, purely for exemplary purposes, to be a temperature of between 200 degrees Fahrenheit (=two temperature units) to 250 degrees Fahrenheit (=two and one-half temperature units), then the controller unit 25 may be controlled to issue a signal to the fan motor 17 and to the module 37 which immediately shuts down the fan motor.

In a yet still further aspect, the ventilation hood 11 also includes a humidity or steam sensor 23, which is connected to the controller unit 25 and serves to detect steam or humidity generated from operation of the cooktop 31. Independent of the operation of the inventive safety system with respect to temperature, if the humidity or amount of steam rises to certain levels, the controller unit is also programmed to increase the speed of the variable speed motor 17 in a predetermined relationship to the amount of steam being generated as a result of operation of the cooktop 31. Additionally, it can be provided in this humidity reaction approach that the temperature driven controls will always take priority and will override steam/humidity driven control.

While the various elements including the temperature sensor 21, the humidity/steam sensor 23, the module 37, the fan motor 17 and the controller unit 25 are shown in a hardwired configuration, it will be readily apparent to those of ordinary skill in the art that these units need not be hardwired and can operate in communication with each other through various other alternative technologies, for example, such as through infrared signals, radio signals, etc.

Yet still further, while in one specific aspect the system is shown as providing an alarm with a signal lamp for warning of reaching the first temperature level, an audible signal also can be provided. Also both audio and visual alarms can be provide at each preset warning level, which can be different in intensity or tone, as will be readily apparent to those of ordinary skill in the art. Alternatively, visible display issuing text message can be employed to provide clear information to the user of the cooktop.

Thus, the present invention provides a ventilator hood safety system having a controller unit connected to a cooktop for controlling the operation thereof, and the controller unit is further programmed for causing an alarm unit to provide a third alarm indication and for shutting down the cooktop and the fan upon the temperature above the cooktop reaching a third predetermined temperature.

The present invention additionally provides a ventilator hood safety system having a humidity sensor for sensing the humidity resulting from steam in proximity to the hood, and associated with the controller unit for having the controller unit increase the speed of the fan in response to increasing humidity. Also, the safety system includes an alarming unit including a signal lamp, and arranged for operation the controller unit for providing the first alarm indication as activation of the signal lamp. The alarming unit may include a sound generator and is arranged for operation with the controller unit for providing the second alarm indication as an audible signal generated by the sound generator. Also, the alarming unit may include a signal lamp and a visual display which are arranged for operation with the controller unit for providing the first alarm indication as activation of the signal lamp, and the second alarm indication may display a text message on the visual display warning of the danger of fire.

Having thus generally described the invention, the same will become better understood from the independent claims as set forth in a non-limiting manner.

What is claimed is:

1. A ventilation hood with a safety system for use with a cooktop having at least one heating element operatively associated therewith, the ventilation hood comprising:

a duct structure for having air flow through the duct structure;

a variable speed fan associated with said duct structure for forcing air to flow from above a cooktop through the duct structure;

a temperature sensor for sensing temperature above the cooktop;

an alarming unit for providing at least one type of alarm indication; and a controller unit for controlling operation of the fan and alarming unit, said controller unit configured for activating the fan at a first speed immediately when the at least one heating element is activated, increasing the speed of the fan and activating the alarming unit to provide a first alarm indication immediately when the temperature above the cooktop reaches a first predetermined level, and for causing the alarming unit to provide a second alarm indication immediately when the temperature above the cooktop reaches a second predetermined level.

2. The ventilation hood of claim 1, wherein said controller unit is connected to a cooktop for controlling operation thereof, said controller unit being further programmed for causing the alarming unit to provide a third alarm indication immediately when the temperature above the cooktop reaching a third predetermined temperature and for shutting down the cooktop and the fan.

3. The ventilation hood of claim 1, further comprising: a humidity sensor for sensing the humidity from steam in proximity to the hood, and associated with the controller unit for having the controller unit increase the speed of the fan in response to increasing humidity resulting from steam.

4. The ventilation hood of claim 1, wherein said alarming unit includes a signal lamp, and is arranged for operation with the controller unit for providing said first alarm indication as activation of said signal lamp.

5. The ventilation hood of claim 1, wherein said alarming unit includes a sound generator, and is arranged for operation with the controller unit for providing said second alarm indication as an audible signal generated by said sound generator.

6. The ventilation hood of claim 1, wherein said alarming unit includes a signal lamp, and a visual display, and which are arranged for operation with the controller unit for providing said first alarm indication as activation of said signal lamp, and said second alarm indication as displaying a text message on said visual display warning of the danger of fire.

7. The ventilation hood of claim 2, wherein said alarming unit includes a signal lamp, and a visual display, and which are arranged for operation with the controller unit for providing said first alarm indication as activation of said signal lamp, said second alarm indication as displaying a text message on said visual display warning of the danger of fire, and said third alarm indication as displaying a text message on said visual display indicating the cooktop and fan have been shut off to prevent a fire.

8. The ventilation hood of claim 7, wherein said cooktop is a gas cooktop.

9. The ventilation hood of claim 1, wherein said controller unit is programmed for increasing said fan speed and for having said alarming unit provide the first alarm indication when the temperature above the cooktop reaches a first predetermined level and for having said alarming unit provide the second alarm indication when the temperature above the cooktop reaches a second predetermined level greater than the first predetermined level.

10. The ventilation hood of claim 2, wherein said controller unit is programmed for increasing said fan speed and for having said alarming unit provide the first alarm indication when the temperature above the cooktop reaches the first predetermined level for having said alarming unit provide the second alarm indication when the temperature above the cooktop reaches the second predetermined level and for shutting down the cooktop and fan when the temperature above the cooktop reaches a third predetermined level greater than the second predetermined level.

11. A method of operating a ventilation hood used with a cooktop having at least one heating element operatively associated therewith, the ventilation hood, comprising:

providing a ventilation hood having a duct structure for having air flow through the duct structure, a temperature sensor for sensing temperature above the cooktop, an alarming unit for providing at least one type of alarm indication, and a controller unit in operative communication with the at least one heating element for controlling operation of the fan and the alarming unit;

activating the fan at a first speed immediately when the at least one heating element is activated;

sensing the temperature above a cooktop, increasing the speed of the fan and providing a first alarm indication immediately when the sensed temperature reaches a first predetermined level; and providing a second alarm indication immediately when the sensed temperature reaches a second predetermined level.

12. The method of claim 11, further comprising:

connecting the controller unit to a cooktop associated with the ventilation hood, and shutting off the cooktop and fan, and providing a third alarm indication immediately when the sensed temperature reaching a third predetermined level.

13. The method of claim 11, further comprising:

providing a humidity sensor for sensing the humidity from steam in proximity to the hood, in association with the controller unit; and sensing the humidity in proximity to the hood and increasing the speed of the fan in relation to sensed humidity.

14. The method of claim 11, wherein said first alarm indication comprises activating a signal lamp.

15. The method of claim 11, wherein said first alarm indication comprises activating a signal lamp, and said second alarm indication comprises providing an audible signal.

16. The method of claim 12, wherein said first alarm indication comprises activating a signal lamp, said second alarm indication comprises displaying a text message warning of the danger of fire, and said third alarm indication comprises displaying a text message indicating the cooktop and fan have been shut off to prevent a fire.

17. The method of claim 16, wherein the cooktop is a gas cooktop.

18. The method of claim 11, further comprising;

increasing the fan speed and providing said first alarm indication immediately when the temperature above the cooktop reaching a first predetermined level and providing the second alarm immediately when the temperature above the cooktop reaches a second predetermined level greater than the first predetermined level.

19. The method of claim 12, further comprising:

increasing the fan speed and providing said first alarm indication immediately when the temperature above the cooktop reaches a first predetermined level, providing the second alarm indication immediately when the temperature above the cooktop reaches a second predetermined level greater than the first predetermined level and shutting off the cooktop and the fan, and providing the third alarm indication immediately when the temperature above the cooktop reaches a third predetermined level greater than the second predetermined level.

20. A ventilation hood and cooktop combination comprising:

a cooktop having at least one heating element operatively associated therewith; and a ventilation hood with a safety system, the ventilation hood including a duct structure for having air flow through the duct structure, a variable speed fan associated with said duct structure for forcing air to flow from above cooktop through the duct structure, a temperature sensor for sensing temperature above the cooktop, an alarming unit for providing at least one type of alarm indication, and a controller unit for controlling operation of the fan and alarming unit, said controller unit configured for activating the fan at a first speed immediately when the at least one heating element is activated, increasing the speed of the fan and for activating the alarming unit to provide a first alarm indication immediately when the temperature above the cooktop reaches a first predetermined level, and for causing the alarm unit to provide a second alarm indication immediately when the temperature above the cooktop reaches a second predetermined temperature.

* * * * *